US009255742B2

(12) United States Patent
Yasunaga

(10) Patent No.: US 9,255,742 B2
(45) Date of Patent: Feb. 9, 2016

(54) SAMPLE COOLING DEVICE AND SAMPLING APPARATUS

(71) Applicant: SHIMADZU CORPORATION, Kyoto-shi, Kyoto (JP)

(72) Inventor: Kenichi Yasunaga, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 59 days.

(21) Appl. No.: 13/773,875

(22) Filed: Feb. 22, 2013

(65) Prior Publication Data

US 2013/0240181 A1 Sep. 19, 2013

(30) Foreign Application Priority Data

Mar. 13, 2012 (JP) ..... 2012-055290

(51) Int. Cl.

| | |
|---|---|
| ***B01L 3/02*** | (2006.01) |
| ***F28D 15/00*** | (2006.01) |
| ***B01L 7/00*** | (2006.01) |
| *B01L 9/06* | (2006.01) |
| *F28F 13/00* | (2006.01) |

(52) U.S. Cl.

CPC . *F28D 15/00* (2013.01); *B01L 7/00* (2013.01); *B01L 9/06* (2013.01); *B01L 2300/1822* (2013.01); *B01L 2300/1844* (2013.01); *B01L 2300/1855* (2013.01); *B01L 2300/1894* (2013.01); *B01L 2400/0406* (2013.01); *F28F 2013/006* (2013.01)

(58) Field of Classification Search

CPC ..... G01N 25/145; G01N 35/10; F28D 15/04

USPC ..... 422/532, 561; 165/104.28

See application file for complete search history.

(56) References Cited

U.S. PATENT DOCUMENTS

| | | | | |
|---|---|---|---|---|
| 6,170,267 | B1 | 1/2001 | Kitaoka | |
| 7,604,782 | B1 * | 10/2009 | Dingell et al. | 422/244 |
| 2003/0003334 | A1 | 1/2003 | Yoshizawa et al. | |
| 2003/0033826 | A1 * | 2/2003 | Moriguchi et al. | 62/315 |

(Continued)

FOREIGN PATENT DOCUMENTS

| | | | |
|---|---|---|---|
| CN | 1247309 | A | 3/2000 |
| CN | 2612888 | Y | 4/2004 |
| CN | 201087812 | Y | 7/2008 |

(Continued)

OTHER PUBLICATIONS

Office Action dated Feb. 3, 2015, issued in Japanese Application No. 2012-055290, w/English translation. (12 pages).

(Continued)

*Primary Examiner* — Jill Warden
*Assistant Examiner* — Brittany Fisher
(74) *Attorney, Agent, or Firm* — Westerman, Hattori, Daniels & Adrian, LLP

(57) ABSTRACT

A sample cooling device for cooling a sample container held in a heat conductive rack comprises a cooler; a heat conductive member, on which the rack is placed, to be cooled in contact with the cooler; and a heat conductive water absorbing member disposed at least partly in an opposite region defined between the heat conductive member and the rack in contact with both of the heat conductive member and the rack. The water absorbing member has a structure for absorbing water by a capillary force.

25 Claims, 4 Drawing Sheets

(56) References Cited

U.S. PATENT DOCUMENTS

| | | | | |
|---|---|---|---|---|
| 2009/0188651 | A1* | 7/2009 | Lin | 165/104.28 |
| 2012/0219473 | A1 | 8/2012 | Ishii et al. | |

FOREIGN PATENT DOCUMENTS

| | | | |
|---|---|---|---|
| CN | 101430116 | A | 5/2009 |
| CN | 101506590 | A | 8/2009 |
| CN | 101520214 | A | 9/2009 |
| CN | 202101465 | U | 1/2012 |
| JP | 61-96367 | U | 6/1986 |
| JP | 62-100471 | U | 6/1987 |
| JP | 63-163754 | A | 7/1988 |
| JP | 10-192719 | A | 7/1998 |
| JP | 2000-137031 | A | 5/2000 |
| JP | 2004-108970 | A | 4/2004 |
| JP | 2004-125649 | A | 4/2004 |
| JP | 2004-212165 | A | 7/2004 |
| JP | 2010-228368 | A | 10/2010 |
| JP | 2010-276555 | A | 12/2010 |

OTHER PUBLICATIONS

Office Action dated Dec. 9, 2014, issued in Chinese Application No. 201310073269.08, w/English translation. (16 pages).

* cited by examiner

SAMPLE COOLING DEVICE AND SAMPLING APPARATUS

BACKGROUND OF THE INVENTION

1. Field of the Invention

The present invention relates to a sample cooling device for cooling a liquid sample to be analyzed in an analyzer for automatically analyzing the liquid sample, such as liquid chromatography, and a sampling apparatus provided with the sample cooling device.

2. Description of the Related Art

A sample rack (hereinafter simply referred to as a rack) for housing therein a plurality of sample containers containing a sample therein and placing them thereon is used in an automatic analyzer for automatically injecting a plurality of samples into a device and then analyzing them (see US 2012/0219473A1).

In an automatic analysis by, for example, liquid chromatography, when a rack housing therein a plurality of sample containers containing therein a small amount of sample is placed in a sampling apparatus, the sampling apparatus sequentially suctions the samples from the sample containers placed on the rack so as to inject them onto an analysis channel of the liquid chromatography according to a preset analysis program. The samples injected into the analysis channel are introduced into an analysis column in a mobile phase where the samples are separated according to components, and then, they are introduced to a detector disposed downstream of the analysis column, to be then detected.

A sample container that contains a sample waiting for an analysis out of the sample containers housed in the rack is generally left at room temperature. Some samples that are put must be kept at low temperature in order to prevent their degradation. In such a case, a sample cooling device is adapted to cool the sample container housed in the rack.

The sample cooling devices are classified into two types: a direct cooling type and an air cooling type. In a direct cooling type, a rack is made of metal having an excellent heat conductivity, and further, a cooler such as a Peltier device is brought into close contact with the bottom of the rack so as to adjust the temperature of a sample. In contrast, in an air cooling type, essential parts of a sampling apparatus including a rack are surrounded by a heat insulating case, and then, air inside of the case is cooled so as to adjust the temperature of a sample. The present invention relates to a sample cooling device of a direct cooling type.

FIG. 5 shows one example of a configuration of a sample cooling device of a direct cooling type in the prior art.

A Peltier device 2 serving as a cooler is fixed to a heat insulator 10. A heat conducting member 6 serving as a plate-like member having a heat conductivity is attached to the cooling surface of the Peltier device 2. The heat conducting member 6 is uniformly cooled by the Peltier device 2. A heat radiating fin 4 is secured to the heat radiating surface of the Peltier device 2, opposite to the cooling surface thereof, so as to allow heat absorbed from the heat conducting member 6 to radiate.

A rack 14 is placed on the heat conducting member 6. The rack 14 is constituted of a base 14*a* at the lower portion thereof and a cover 14*b* at the upper portion thereof. The base 14*a* is made of a material having an excellent heat conductivity such as aluminum whereas the cover 14*b* is made of a resin. The bottom surface of the base 14*a* is brought into direct contact with the surface of the heat conducting member 6, and further, the base 14*a* is cooled to a predetermined temperature by heat (cold heat) transmitted from the Peltier device 2 via the heat conducting member 6.

The rack 14 is provided with a plurality of concave portions for holding sample containers 16, respectively, each of which contains a liquid sample therein. The sample containers 16 housed in the concave portions, respectively, are cooled to a predetermined temperature by the Peltier device 2 via the base 14*a* and the heat conducting member 6. The cover 14*b* made of the resin is provided for keeping the coolness of the sample containers 16 that have been cooled by the base 14*a*.

The sample cooling device of the direct cooling type shown in FIG. 5 has an advantage: it has a high heat conductivity, and therefore, it can be cooled down to the predetermined temperature in a short period of time, so that the temperature of the plurality of sample containers 16 housed in the rack 14 can be uniformly controlled. On the other hand, there arises a problem that moisture in the atmosphere during a cooling process is condensed on the sample containers 16, the base 14*a* of the rack 14, or the heat conducting member 6, thereby producing condensed water. When the rack 14 or the sample container 16, to which the condensed water adheres, is moved, the condensed water drops to dirty the surroundings or produces rust or mold. In view of this, it is inconvenient to treat the rack 14 or the sample container 16.

A sampling apparatus adopting the sample cooling device of the direct cooling type has taken the measures against the above-described problem by surrounding a space including the heat conducting member 6 and the rack 14 via a casing so as to provide a closed space isolated from the outside air, and further, housing a Peltier device for removing moisture inside of the casing so as to reduce the moisture inside of the casing. However, the outside air enters the casing when the rack 14 is put in or taken out, or a liquid tank of a needle cleansing liquid is housed inside of the casing, and therefore, it is markedly difficult to completely prevent the condensation in the rack 14 or the heat conducting member 6.

In view of the above, the condensed water always stays between the rack 14 and the heat conducting member 6 in the conventional sample cooling device, and therefore, the condensed water cannot be removed unless an analyzing person wipes it off.

SUMMARY OF THE INVENTION

An object of the present invention is to speedily eliminate condensed water produced between a rack and a heat conducting member having the rack placed thereon.

A sample cooling device according to the present invention is provided with a cooler and a heat conducting member to be cooled in contact with the cooler, so as to cool a sample container held by a heat conductive rack having the sample container therein mounted in direct or indirect contact with the heat conducting member. The feature of the present invention resides in that a heat conductive water absorbing member having a structure for absorbing condensed water produced between the heat conducting member and the rack by a capillary force is disposed at a surface of the heat conducive member, on which the rack is mounted. The water absorbing member is disposed at least partly in the opposite region between the heat conducting member and the rack, and thus, the water absorbing member is brought into contact with both of the heat conducting member and the rack.

In the sample cooling device according to the present invention, the heat conductive water absorbing member having the structure for absorbing the condensed water produced between the heat conducting member and the rack by a capillary force is disposed at the surface of the heat conducting member, on which the rack is mounted, thus speedily eliminating the condensed water produced between the heat conducting member and the rack. Consequently, when the rack is moved, a liquid cannot drop around, thereby preventing generation of mold or the like in the rack or the heat conducting member.

A sampling apparatus according to the present invention includes a sample cooling device for cooling a sample container held by a heat conductive rack that holds therein the sample container containing a sample therein and a needle that moves to the position of the sample container held by the rack disposed in the sample cooling device so as to suction a sample contained in the sample container, wherein the sample cooling device is the sample cooling device according to the present invention.

The sampling apparatus according to the present invention is provided with the sample cooling device according to the present invention. Consequently, no condensed water can stay at and around the rack, thereby preventing any problems such as generation of rust or mold around.

DETAILED DESCRIPTION OF THE INVENTION

Figure 1:
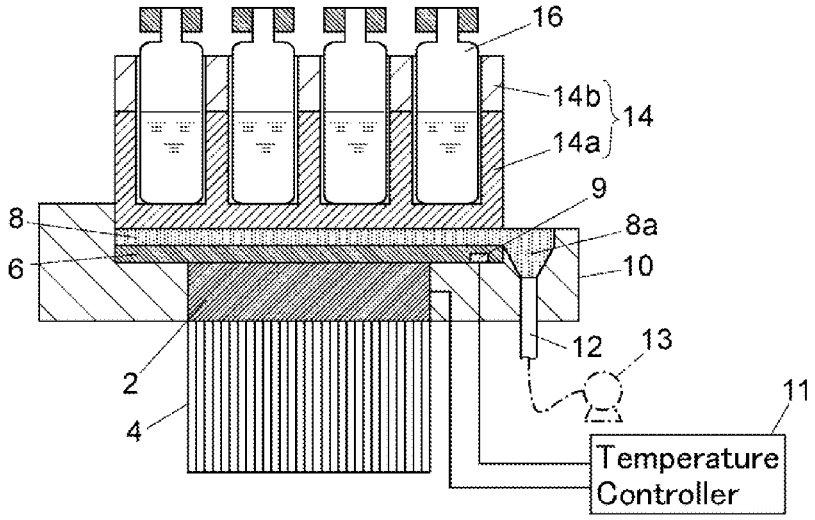
FIG. 1 is a cross-sectional view schematically showing the configuration of a sample cooling device in a preferred embodiment.

A sample cooling device in a preferred embodiment according to the present invention uses a porous member provided with a plurality of pores, each having an inner diameter enough to allow a capillary force of a water absorbing member to act.

The porous member is made of, for example, an aluminum sintered material, a stainless sintered material, or a nickel sintered material.

Moreover, it is preferable that at least a part of an end of the water absorbing member should serve as a drain that extends outward from between the heat conducting member and the rack and drains water absorbed by the water absorbing member therefrom. In other words, the water absorbing member extends outside in the opposite region, and at least a part of the water absorbing member existing outside of the opposite region serves as the drain. In this manner, condensed water that stays between the rack and the heat conducting member is absorbed by the water absorbing member and can be drained to the outside without overflowing at the water absorbing member, so that water absorbency of the water absorbing member can be maintained.

When the drain is disposed, one end of a drain tube for recovering water drained from the drain may be connected to the lower portion of the drain, so as to collect the water drained from the drain. In one preferred embodiment in the case where the drain tube is disposed, the drain is tapered downward in order to collect the water at one end of the drain tube by its own weight. In another preferred embodiment in the case where the drain tube is disposed, a small-sized pump is connected to the other end of the drain tube, so as to forcibly eliminate the water absorbed by the water absorbing member.

In the case where the drain is disposed, a tray for recovering the water drained from the drain may be disposed at the lower portion of the drain.

The water absorbing member may be disposed only at a part of the opposite region whereas the heat conductive member and the rack are brought into direct contact with each other in the residual opposite region. Alternatively, the water absorbing member may be disposed over the entire opposite region.

A sample cooling device and a sampling apparatus in preferred embodiments according to the present invention will be described below with reference to the attached drawings.

First, a description will be given of a sample cooling device in a preferred embodiment with reference to FIG. 1.

A Peltier device 2 serving as a cooler is fixed to a heat insulator 10. A heat conducting member 6 serving as a plate-like member having a heat conductivity is attached to the cooling surface of the Peltier device 2. The heat conducting member 6 is substantially uniformly cooled by the Peltier device 2. A heat radiating fin 4 is secured to the heat radiating surface of the Peltier device 2, opposite to the cooling surface thereof, so as to allow heat absorbed from the heat conducting member 6 to radiate.

A temperature sensor 9 is embedded in the heat conducting member 6. A temperature controller 11 for controlling the drive of the Peltier device 2 takes in a detection signal from the temperature sensor 9 so as to detect the temperature of the heat conducting member 6, and then, supplies a current to the Peltier device 2 in such a manner as to zero the difference between the temperature of the heat conducting member 6 and a predetermined target temperature, thereby controlling the temperature of the heat conducting member 6 to the temperature.

A thermally conductive porous member 8 having a thickness of about 5 mm and serving as a water absorbing member is mounted on the heat conducting member 6. The porous member 8 is formed into a plate-like shape. The porous member 8 is cooled to a constant temperature by the Peltier device 2 via the heat conducting member 6.

A rack 14 is placed at the upper surface of the porous member 8. The rack 14 is constituted of a base 14*a* at the lower portion thereof and a cover 14*b* at the upper portion thereof. The base 14*a* is made of a material excellent in heat conductivity such as aluminum whereas the cover 14*b* is made of a resin.

The base 14*a* of the rack 14 is brought into direct contact with the porous member 8 and is cooled to a constant temperature by the Peltier device 2 via the porous member 8 and the heat conducting member 6. The base 14*a* of the rack 14 is provided with a plurality of concave portions for housing therein sample containers 16, each having a liquid sample contained therein. The sample container 16 housed in the concave portion formed in the rack 14 is cooled by the Peltier device 2 via the base 14, the porous member 8, and the heat conducting member 6, and thus, the liquid sample contained inside of the sample container 16 is cooled.

The cover 14*b* is provided with through holes at positions corresponding to the concave portions formed in the base 14*a*, and further, is adapted to hold the sample containers 16 in the state in which the upper portions of the sample containers 16 are exposed to the outside. The cover 14 made of the resin is provided for keeping the coolness of the cooled sample containers 16 at a constant temperature. Incidentally, the depth of each of the concave portions formed in the base 14*a* accords with the height of the liquid level of the liquid sample contained in the sample container 16 housed in the concave portion, and thus, the liquid sample can be efficiently cooled.

The porous member 8 is a water absorbing member provided with a plurality of pores, each having an inner diameter enough to act a capillary force. The inner diameter of the pore is, for example, about 10 μm in average. Water staying between the heat conducting member 6 and the rack 14 is absorbed by the capillary force. An aluminum sintered material, a stainless (SUS 316 or SUS 304) sintered material, and a nickel sintered material may be used for the porous member 8.

One end 8*a* of the porous member 8 extends outward from above the heat conducting member 6, and then serves as a drain. To the lower portion of the one end 8*a* is connected one end of a drain tube 12. The one end 8*a* is tapered downward in such a manner that water absorbed in the pores of the porous member 8 is collected at one end of the drain tube 12 by its own weight. In this manner, condensed water that stays between the heat conducting member 6 and the rack 14 and is absorbed by the porous member 8 can be drained to the outside without overflowing. Consequently, the water absorbency of the porous member 8 can be maintained.

Although the other end of the drain tube 12 is not shown, the other end of the drain tube 12 may be located at a position lower than the sample cooling device so that the condensed water absorbed by the porous member 8 may be drained to the outside by its own weight. Alternatively, a small-sized pump 13 is disposed at the other end of the drain tube 12, thereby forcibly eliminating the condensed water absorbed by the porous member 8. In the case where the pump 13 is used, the pump 13 may be driven periodically or by an analyzing person, as required.

The structure of the drain for draining, from the absorbing member, the water absorbed by the absorbing member interposed between the heat conducting member 6 and the rack 14 is not limited to that in the preferred embodiment shown in FIG. 1. For example, in another preferred embodiment shown in FIG. 2, one end of a porous member 18 made of the same material as that of the porous member 8 shown in FIG. 1 extends outward from above a heat conducting member 6, and further, a tray 20 is provided at the lower portion of the extended portion, for recovering condensed water absorbed by the porous member 18. The condensed water recovered in the tray 20 may be periodically drained by a drain tube, not shown. Alternatively, a liquid level sensor may be attached to the tray 20, so that when the liquid level sensor detects that the level of water reserved in the tray 20 becomes a constant value or higher, the drain tube may drain the condensed water reserved in the tray 20.

Figure 3:
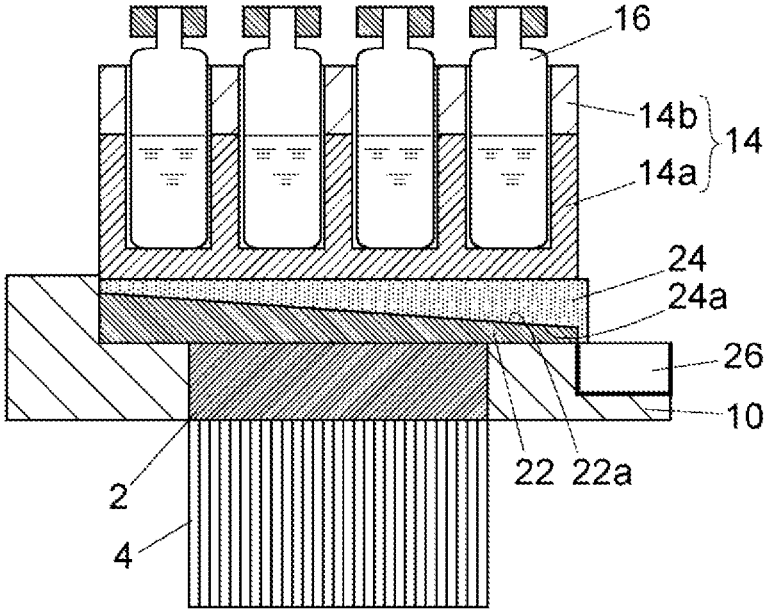
FIG. 3 is a cross-sectional view schematically showing a sample cooling device in a further preferred embodiment.

In a further preferred embodiment shown in FIG. 3, the upper surface 22*a* of a heat conducting member 22 is inclined, and further, the lower surface 24*a* of a porous member 24 is inclined in conformity with the upper surface 22*a* of the heat conducting member 22. In this manner, condensed water absorbed by the porous member 24 is designed to be recovered in a tray 26 disposed at one end by its own weight. Also in this preferred embodiment, the condensed water recovered in the tray 26 may be periodically drained by a drain tube, not shown. Alternatively, a liquid level sensor may be attached to the tray 26, so that when the liquid level sensor detects that the level of water reserved in the tray 26 becomes a constant value or higher, the drain tube may drain the condensed water reserved in the tray 26.

Figure 2:
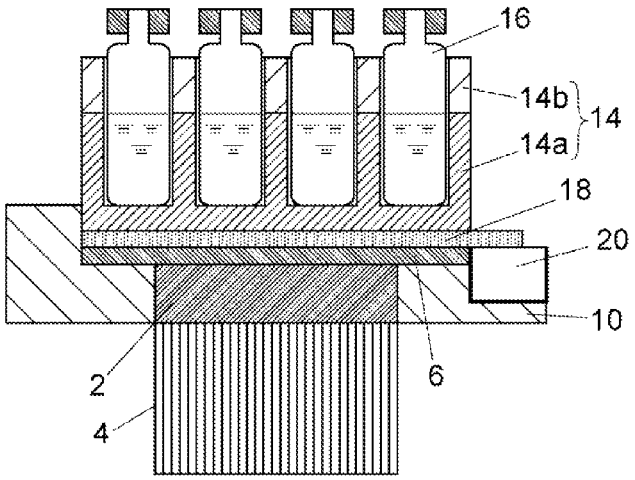
FIG. 2 is a cross-sectional view schematically showing a sample cooling device in another preferred embodiment.

Although in each of the preferred embodiments shown in FIGS. 1 to 3, the structure for draining the condensed water absorbed by the porous member 8, 18, or 24 is disposed at one end of the porous member, the structure may surround the entire periphery of the porous member.

The water absorbing member such as the porous members 8, 18, and 24 exhibits the highest absorbing efficiency of the condensed water when it covers the entire surface of a range at which the rack 14 is disposed. However, the water absorbing member has a portion other than the heat conductive material, that is, the pores of the porous member. Therefore, even if the water absorbing member is made of the same material as that of the heat conducting member 6 or 22, the water absorbing member exhibits a heat conductivity lower than that of the heat conducting member 6 or 22. Consequently, the water absorbing member may be located at a part of the range at which the rack 14 is disposed whereas a member made of a material having a high heat conductivity may be disposed at the residual portion. Even if the water absorbing member is partly disposed, the condensed water can be effectively absorbed. Thus, the present invention is significant.

Figure 4:
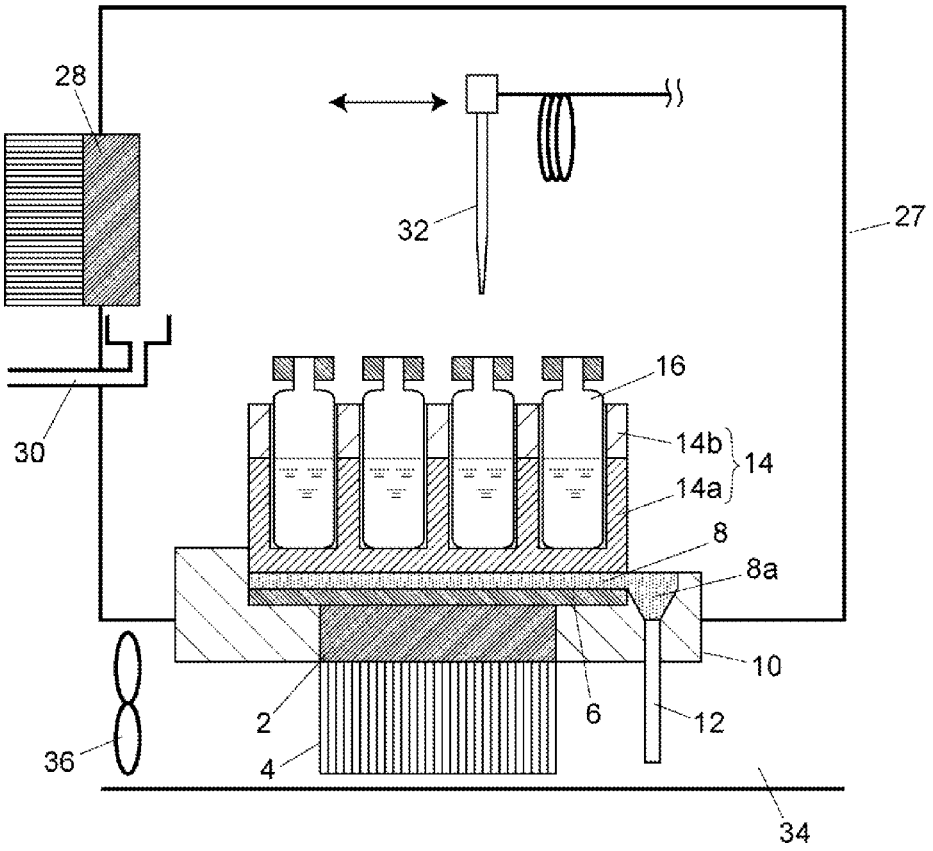
FIG. 4 is a cross-sectional view schematically showing the configuration of a sampling apparatus in a preferred embodiment.
Figure 5:
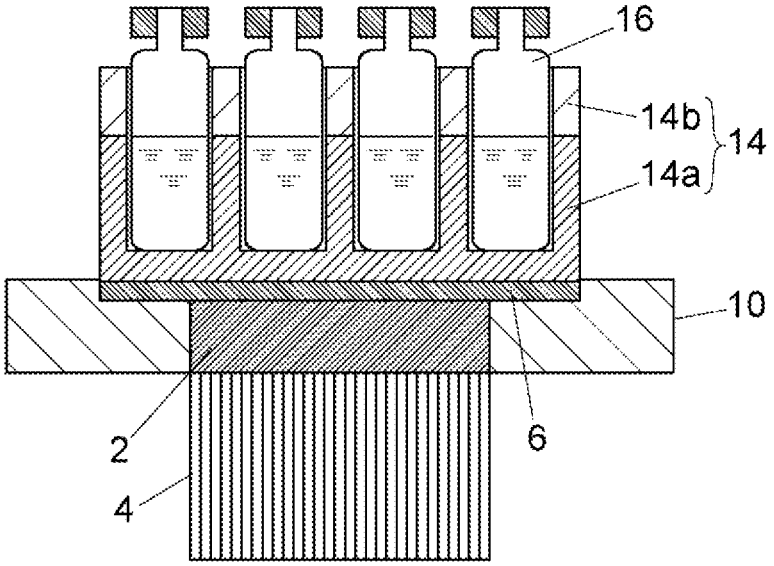
Fig. 5 Prior Art
FIG. 5 is a cross-sectional view schematically showing a sample cooling device in the prior art.

Next, a description will be given of a sampling apparatus in one preferred embodiment with reference to FIG. 4. Although in this preferred embodiment, the sample cooling device shown in FIG. 1 is used as a sample cooling device, the sample cooling devices having the structures shown in FIGS. 2 and 3 may be used.

The section above the heat insulating member 10 in the sample cooling device shown in FIG. 1 is put in a closed space surrounded by a casing 27. The casing 27 houses therein a sample injector for injecting a sample into an analysis channel of a liquid chromatography in addition to a needle 32 for taking in and sampling a sample from the sample container 16 housed in the rack 14 disposed in the sample cooling device and a drive unit, not shown, for driving the needle 32.

The needle 32 is moved inward on a horizontal plane and in a vertical direction. The needle 32 is moved to a position above the sample container 16 having a target sample contained therein out of the sample containers 16 housed in the rack 14 disposed in the sample cooling device, descends from this position, pierces a lid made of septum or the like for sealing the upper surface of the sample container 16, and thus, suctions the sample contained in the sample container 16. The needle that has suctioned the sample therein is moved to the sample injector connected to the analysis channel of the liquid chromatography, and then, injects the sample.

A duct 34 is disposed outside of the casing 27. The heat radiating fin 4 attached to the cooling surface of the Peltier device 2 is disposed inside of the duct 34. A fan 36 is disposed in the duct 34 in order to ventilate air, so that heat absorbed by the heat conducting member 6 radiates.

Another Peltier device 28 is housed at the casing 27, for cooling and dehumidifying the inside of the casing 27. Moreover, a drain 30 for recovering condensed water produced in the Peltier device 28 is disposed under the Peltier device 28.

Since the water absorbing member such as the porous member is provided in the sample cooling device in the sampling apparatus according to the present invention, it is not always necessary to dehumidify the inside of the closed space where the heat conducting member 6 or the rack 14 is housed. However, the sampling apparatus is such configured as shown in FIG. 4, thereby reducing the amount of condensed water produced between the heat conducting member 6 and the rack 14, so as to further enhance the effect with respect to the condensation.

What is claimed is:

1. A sample cooling device for cooling a sample container held in a heat conductive rack, the sample cooling device comprising:

a cooler;

a heat conductive member having an upper surface configured to support a rack thereon, said heat conductive member being in contact with the cooler such as to be cooled by said cooler; and a heat conductive water absorbing member disposed at least partly in a region defined between the upper surface of the heat conductive member and a rack position and configured such as to be in contact with both of the heat conductive member and a rack positioned in said rack position, the water absorbing member having a structure for absorbing water by a capillary force, wherein the water absorbing member is a porous member provided with a plurality of pores, each having an inner diameter enough to allow a capillary force to act.

2. A sample cooling device according to claim 1, wherein the water absorbing member extends outside of said region, at least a part of the water absorbing member existing outside of the region serving as a drain for draining, from the water absorbing member, the water absorbed by the water absorbing member.

3. A sample cooling device according to claim 2, wherein one end of a drain tube for recovering the water drained from the drain is connected to the lower portion of the drain.

4. A sample cooling device according to claim 3, wherein the drain is tapered downward in such a manner as to collect the water at said one end of the drain tube by its own weight.

5. A sample cooling device according to claim 3, wherein a small-sized pump is connected to the other end of the drain tube, so as to forcibly eliminate the water absorbed by the water absorbing member.

6. A sample cooling device according to claim 2, wherein a tray for recovering the water drained from the drain is disposed at the lower portion of the drain.

7. A sample cooling device according to claim 1, wherein the porous member is made of a material selected from the group consisting of an aluminum sintered material, a stainless sintered material, and a nickel sintered material.

8. A sample cooling device according to claim 1, wherein the water absorbing member is disposed only at a part of said region, whereas the heat conductive member and the rack are brought into direct contact with each other in other parts of said region.

9. A sample cooling device according to claim 1, wherein the water absorbing member is disposed over the entire said region.

10. A sampling apparatus comprising:

a sample cooling device for cooling a sample container held by a heat conductive rack that holds therein the sample container containing a sample therein; and a needle moving to the position of the sample container held by the rack disposed in the sample cooling device so as to suction a sample contained in the sample container, wherein the sample cooling device includes:

a cooler; a heat conductive member having an upper surface configured to support a rack thereon, said heat conductive member being in contact with the cooler such as to be cooled by said cooler; and a heat conductive water absorbing member disposed at least partly in a region defined between the upper surface of the heat conductive member and a rack position and configured such as to be in contact with both of the heat conductive member and a rack positioned in said rack position, the water absorbing member having a structure for absorbing water by a capillary force.

11. The sampling apparatus according to claim 10, wherein the water absorbing member extends outside of said region, at least a part of the water absorbing member existing outside of the region serving as a drain for draining, from the water absorbing member, the water absorbed by the water absorbing member.

12. The sampling apparatus according to claim 11, wherein one end of a drain tube for recovering the water drained from the drain is connected to the lower portion of the drain.

13. The sampling apparatus according to claim 12, wherein the drain is tapered downward in such a manner as to collect the water at said one end of the drain tube by its own weight.

14. The sampling apparatus according to claim 12, wherein a small-sized pump is connected to the other end of the drain tube, so as to forcibly eliminate the water absorbed by the water absorbing member.

15. The sampling apparatus according to claim 11, wherein a tray for recovering the water drained from the drain is disposed at the lower portion of the drain.

16. The sampling apparatus according to claim 10, wherein the water absorbing member is a porous member provided with a plurality of pores, each having an inner diameter enough to allow a capillary force to act.

17. The sampling apparatus according to claim 16, wherein the porous member is made of a material selected from the group consisting of an aluminum sintered material, a stainless sintered material, and a nickel sintered material.

18. The sampling apparatus according to claim 10, wherein the water absorbing member is disposed only at a part of said region, whereas the heat conductive member and the rack are brought into direct contact with each other in other parts of said region.

19. The sampling apparatus according to claim 10, wherein the water absorbing member is disposed over the entire said region.

20. A sampling apparatus, comprising:

a sample cooling device comprising:

a cooler; a heat conductive member having an upper surface configured to support a rack thereon, said heat conductive member being in contact with the cooler such as to be cooled by said cooler; and a heat conductive water absorbing member disposed at least partly in a region defined between the upper surface of the heat conductive member and a rack position and configured such as to be in contact with both of the heat conductive member and a rack positioned in said rack position, the water absorbing member having a structure for absorbing water by a capillary force; and a needle configured to be moved to a position of a sample container held by a rack positioned in said rack position in the sample cooling device so as to suction a sample contained in the sample container.

21. The sampling apparatus of claim 20, wherein the water absorbing member is a porous member containing a plurality of pores having an inner diameter sized to create a capillary force on water that causes water to be absorbed into said plurality of pores.

22. The sampling apparatus of claim 20, wherein said water absorbing member serves as a drain for draining from the water absorbing member.

23. The sampling apparatus of claim 20, further including a case containing said sample cooling device and said needle and including a drain tube connected to said drain and for draining water out of said case.

24. The sampling apparatus of claim 23, further including an air cooling device within said case and a drain for draining water from said air cooling device outside of said container.

25. The sampling apparatus of claim 20, further including a rack positioned in said rack position, said rack having a plurality of sample containers supported in said rack.

* * * * *